US005626441A

United States Patent [19]

Grebenyuk

[11] Patent Number: 5,626,441

[45] Date of Patent: May 6, 1997

[54] SLIDING STABILIZER

[76] Inventor: Boris Grebenyuk, 2567 Sandalwood Cir., Ann Arbor, Mich. 48105

[21] Appl. No.: 499,741

[22] Filed: Jul. 7, 1995

[51] Int. Cl.[6] ..... E21D 15/14; E21D 23/00

[52] U.S. Cl. ..... 405/293; 405/294; 405/299

[58] Field of Search ..... 405/293, 294, 405/295, 298, 299

[56] References Cited

U.S. PATENT DOCUMENTS

| | | | |
|---|---|---|---|
| 4,309,130 | 1/1982 | Bemmerl | 405/294 |
| 4,309,131 | 1/1982 | Bollmann | 405/294 |

FOREIGN PATENT DOCUMENTS

| | | |
|---|---|---|
| 2247620 | of 1974 | Germany . |
| 1109524 | 4/1984 | U.S.S.R. . |

OTHER PUBLICATIONS

Thomas M. Barczak, History and Future of Longwall Mining in the U.S., 1992 Bureau of Mines IC9316, p. 10, Fig. 16.

Donbass 5—no references cited—personal inspection 1983.

*Primary Examiner*—Tamara L. Graysay

*Assistant Examiner*—Tara L. Mayo

[57] ABSTRACT

A sliding stabilizer is a machine for supporting the roof in the working zone of a mine. A sliding stabilizer operates in tandem with a mining roof support machine. A sliding stabilizer is capable of supporting the mine roof independently of the roof support machine. A sliding stabilizer has a peak roof covering, a flexible sheet that extends toward the roof covering of a support machine, and a rotating retractable leg. The retractable leg rotates from the mineral seam to inside the roof covering of a support machine. The retractable leg propels the peak into the working zone of the shearer. A sliding stabilizer supports a previously insupportable roof.

2 Claims, 12 Drawing Sheets

23
26
69
71
32
28
42
24
22
25
30
58
21
38
40
31
37
33
68
74
50

60
24
41
52

43
26
56
57
55

26
46
51

54
70

51
42
59

Fid. 7a

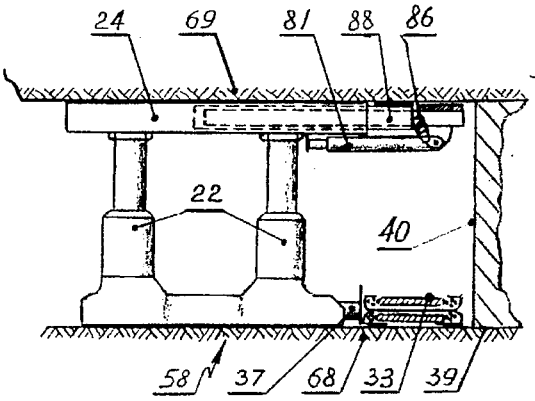
Fig. 17a - prior art
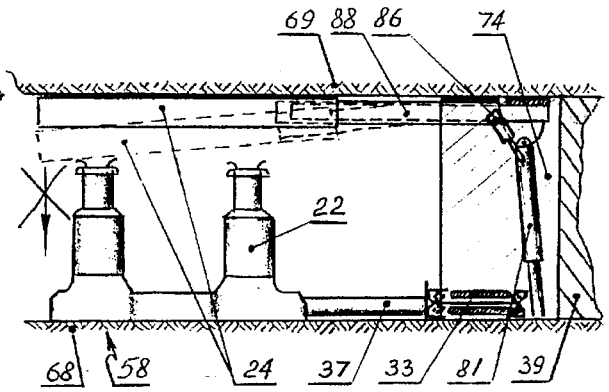
Fig. 17b - prior art
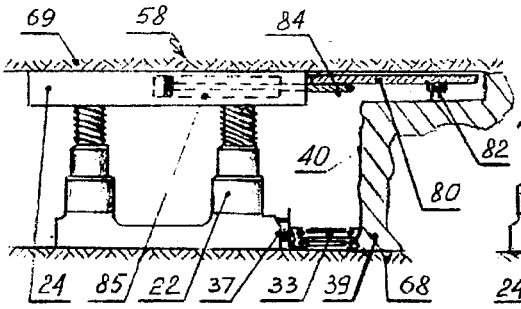
Fig 17c - prior art
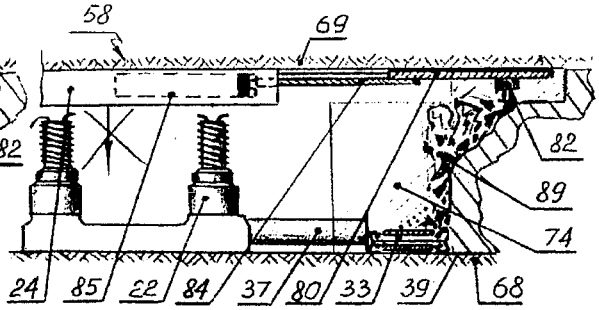
Fig. 17d - prior art
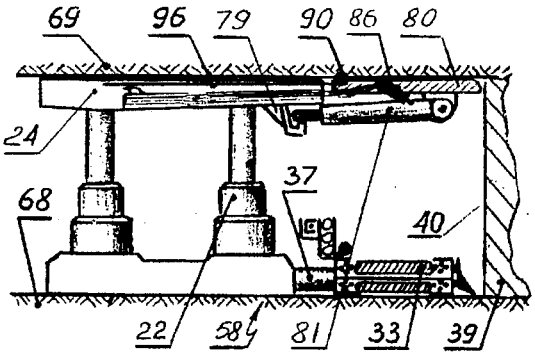
Fig. 17e - prior art
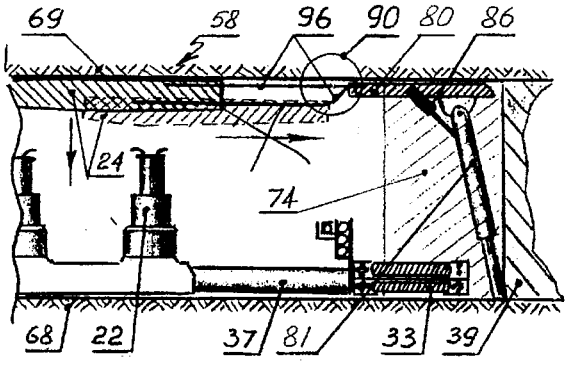
Fig. 17f - prior art
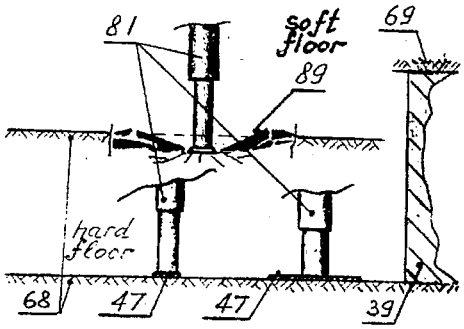
Fig. 17g - prior art

SLIDING STABILIZER

BACKGROUND-CROSS REFERENCES

None

1. Background-Field of Invention

The novel invention is a sliding stabilizer that operates in tandem with a mining roof support machine and is particularly useful in longwall mining operations.

2. Background-Description of the Prior Art

As mineral mining becomes deeper, the threat of rock bursts becomes greater. This is a problem that has been common in deep hard rock and mineral mines for years. It will be an ever-increasing problem as mining at greater depths is required. Despite gains, this threat is not controlled. In deeper seams, consideration must be given to support, safety anti stability. Additional design is required. Currently three types of mining roof support machines are popular: frame, chock, and shield. All three have to a greater or lesser degree safety, stability and ventilation problems. Problems of particular consideration are: (1) the rock burst problem that exists from the unsupported roof created when a shearer passes a support machine; (2) the rock burst problem that exists as a roof covering of a support machine is lowered to advance; (3) lack of stability caused by oversize roof coverings in an attempt to create more ventilation; (4) mineral bursts from a mineral face; (5) instability in support machines caused by inclined seams; and (6) lack of work space in thin seams.

Rigid canopies have been designed in order to help with the above listed problems. They have not worked. (1) When the roof covering of the support machine is lowered, the rigid canopy also lowers., This creates a large unsupported roof and the potential for rock bursts. (2) The rigid canopy extends from the support machine and becomes unstable. Rock bursts can cause canopy rotation.

In three prior designs rigid canopies also have attached legs. These have not worked. (1) The legs interfere with the working space and ventilation. (2) The connections of the canopies break if the leg is not lowered with the roof covering of the support machine.

3. Objects and Advantages

Miners throughout the world are demanding safe working conditions. World energy demand continues to increase. Therefore, it is a general object and advantage of a sliding stabilizer to provide support, stability, safety, and efficiency in longwall mining operations.

In addition to the object and advantage above, it its the object and advantage of a sliding stabilizer:

(1) to provide ventilation and working space;

(2) to provide support, stability and safety to enable mining of inclined seams;

(3) to provide ventilation and working space to enable mining of thin seams;

(4) to provide support, stability and safety to enable mining of deeper seams; and (5) to provide support, stability, safety, ventilation and working space in the working zone of the shearer in longwall mining operations.

In addition it is the object and advantage of a sliding stabilizer:

(1) to prevent rock bursts from the unsupported roof created as a shearer passes a support machine;

(2) to prevent rock bursts from the unsupported roof created when the roof covering of a support machine is lowered to allow the support machine to advance;

(3) to prevent mineral bursts from the mineral face;

(4) to prevent canopy rotation from rock bursts; and (5) to prevent canopy breakage when the roof covering of the support machine is lowered.

DESCRIPTION OF THE DRAWINGS

FIG. 3*a* is a diagram showing the position of a mining equipment set including a sliding stabilizer before the beginning of mineral extraction.

FIG. 3*b* is a diagram showing a sliding stabilizer immediately after the pass of a shearing machine.

FIG. 3*c* is a diagram of the position where a retractable leg sets up by the mineral face.

FIG. 3*d* is a diagram of the positioning of a conveyor toward the new mineral face.

FIG. 3*e* is a diagram showing how a sliding stabilizer continues as an independent support element as a roof support machine with lowered roof covering advances toward the mineral face.

FIGS. 7*a*, 7*b* are views from below of a sliding tongue.

FIG. 15*a* is a diagram of a support machine with a rigid canopy during a rock burst.

FIG. 16*c* is a diagram showing the shearer passing a sliding stabilizer in a thin seam.

FIGS. 17*a*, 17*b* are diagrams of prior art, German Patent #2247620.

FIG. 17*a* shows that the hydraulic leg cannot rotate into the roof covering.

FIG. 17*b* shows that the telescoping canopy will break when the hydraulic props of the support machine are lowered.

FIGS. 17*c*, 17*d* are diagrams of prior art, Donbass 5 support machine.

FIG. 17*d* shows that the mineral face will burst when the hydraulic props of the support machine are lowered.

FIGS. 17*e*, 17*f* are diagrams of prior art, Soviet Patent #1109524.

FIG. 17*e* shows that the hydraulic leg cannot rotate into the roof covering.

FIG. 17*f* shows that the canopy junction will break when the hydraulic props of the support machine are lowered.

LIST OF REFERENCE NUMERALS

Figure 1:
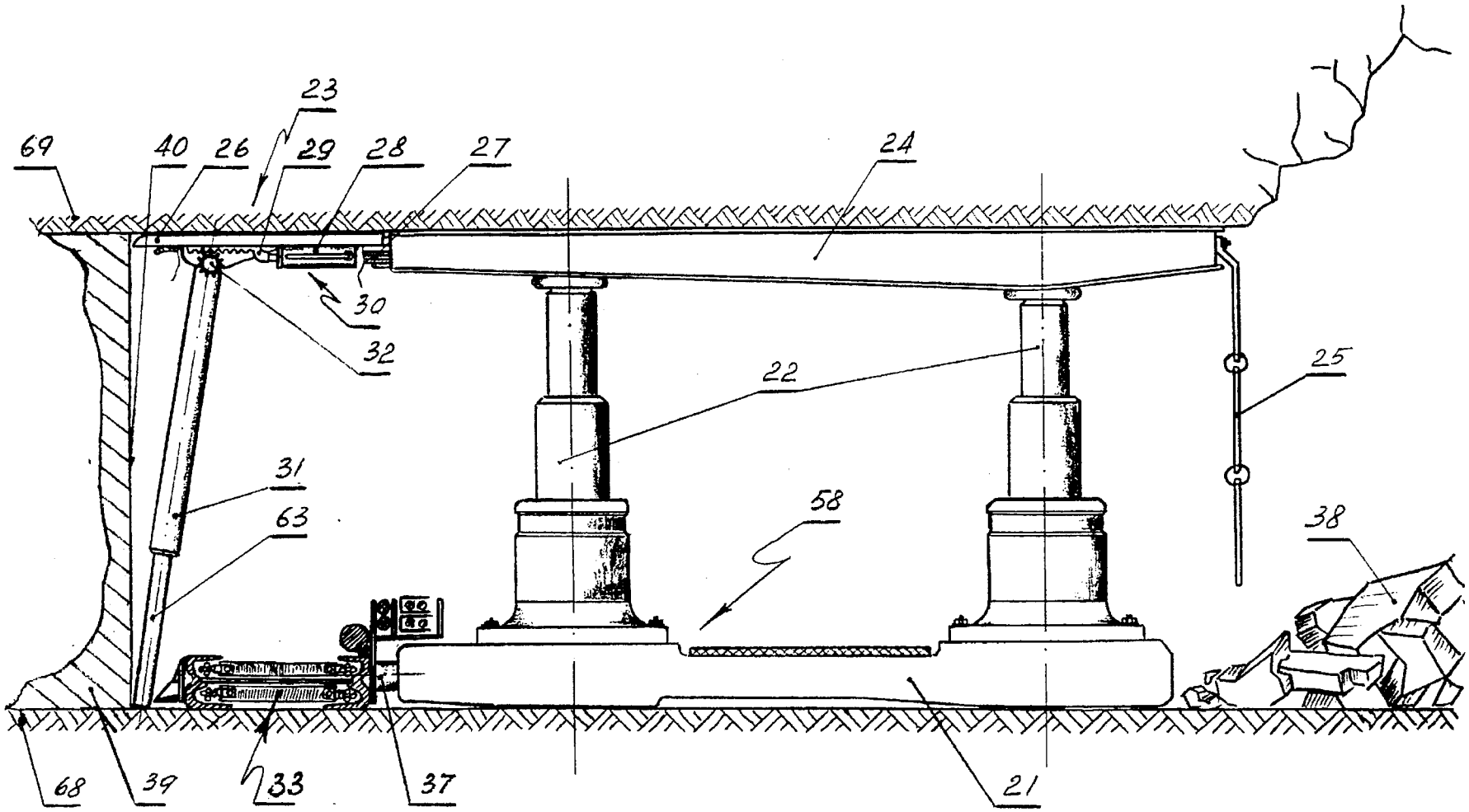
FIG. 1 is a side view of a mining equipment set including a support machine, conveyor, and sliding stabilizer.

| Number | Location | Part Name |
|---|---|---|
| 21 | support | base |
| 22 | support | hydraulic props |
| 23 | stabilizer | sliding stabilizer |
| 24 | support | roof covering |
| 25 | support | enclosure |
| 26 | stabilizer | peak |
| 27 | stabilizer | expandable springs |
| 28 | stabilizer | hydraulic cartridge |
| 29 | stabilizer | toothed tongue |
| 30 | stabilizer | sliding tongue |
| 31 | stabilizer | retractable leg |
| 32 | stabilizer | gear wheel |
| 33 | conveyor | conveyor |
| 37 | support | hydraulic ram |
| 38 | mine | gob |
| 39 | mine | mineral seam |
| 40 | mine | mineral face |
| 41 | covering | cover ribs |
| 42 | stabilizer | flexible sheet |
| 43 | stabilizer | hard brackets |
| 44 | stabilizer | assembly pin |
| 45 | covering | stopper plate |
| 46 | stabilizer | peak thorns |
| 47 | stabilizer | leg heel |
| 48 | stabilizer | flexible hose |
| 49 | covering | rib bracket |
| 50 | mine | roof gap |
| 51 | stabilizer | peak junction |
| 52 | covering | sidewalls |
| 53 | covering | stopper wedge |
| 54 | stabilizer | springs junction |
| 55 | stabilizer | fixing holes |
| 56 | stabilizer | fixing rod |
| 57 | stabilizer | cram pin |
| 58 | support | support machine |
| 59 | stabilizer | sheet hole |
| 60 | covering | cover hollow |
| 61 | stabilizer | cartridge plate |
| 62 | stabilizer | cartridge stem |
| 63 | stabilizer | leg stem |
| 64 | stabilizer | leg head |
| 65 | stabilizer | assembly hole |
| 66 | covering | rib wedge |
| 67 | stabilizer | cram pin |
| 68 | mine | floor |
| 69 | mine | roof |
| 70 | stabilizer | sheet runners |

-continued

| Number | Location | Part Name |
|---|---|---|
| 71 | mine | web |
| 72 | shearer | left drum |
| 73 | mine | narrow face |
| 74 | mine | working zone |
| 75 | shearer | right drum |
| 76 | shearer | drum teeth |
| 77 | shearer | shearer |
| 78 | mine | ventilation zone |
| 79 | prior art | fixing hook |
| 80 | prior art | rigid canopy |
| 81 | prior art | hydraulic leg |
| 82 | prior art | cartridge leg |
| 84 | prior art | piston rod |
| 85 | prior art | piston cylinder |
| 86 | prior art | hydraulic cartridge |
| 88 | prior art | telescoping canopy |
| 89 | prior art | mineral burst |
| 90 | prior art | canopy junction |
| 96 | prior art | canopy sheet |

SUMMARY

A sliding stabilizer operates in tandem with the roof support machine. A sliding stabilizer provides safety, support, stability, working space and ventilation independently of the support machine at the most crucial times during mineral extraction. A sliding stabilizer is capable of operating with any support machine that has modifications of the roof covering allowing such operation. A sliding stabilizer has a peak, a flexible sheet, and a leg with gear wheel.

A sliding stabilizer will support a previously insupportable roof above the working zone of a mine as a shearer passes the support machine. A sliding stabilizer will support a previously insupportable roof above the working zone of a mine as a support machine advances toward the mineral face. A sliding stabilizer prevents canopy rotation due to rock bursts in the mine roof. A sliding stabilizer prevents canopy breakage due to lowering the roof covering of a support machine. A sliding stabilizer will prevent a support machine from overturning while advancing on an inclined seam.

DESCRIPTION OF THE INVENTION

With reference to FIG. 1 and other illustrations, there is a roof support machine 58 and a mineral face conveyor 33 with a sliding stabilizer 23 between a mineral seam 39 and the gob 38. A re,of support machine 58 has a base 21 and hydraulic props 22 that hold up a roof covering 24. An enclosure 25 hangs from the rear of the covering 24. A hydraulic ram 37 from the base 21 propels a conveyor 33.

Figures 6A, 6B, 6C, 6D, 6E:
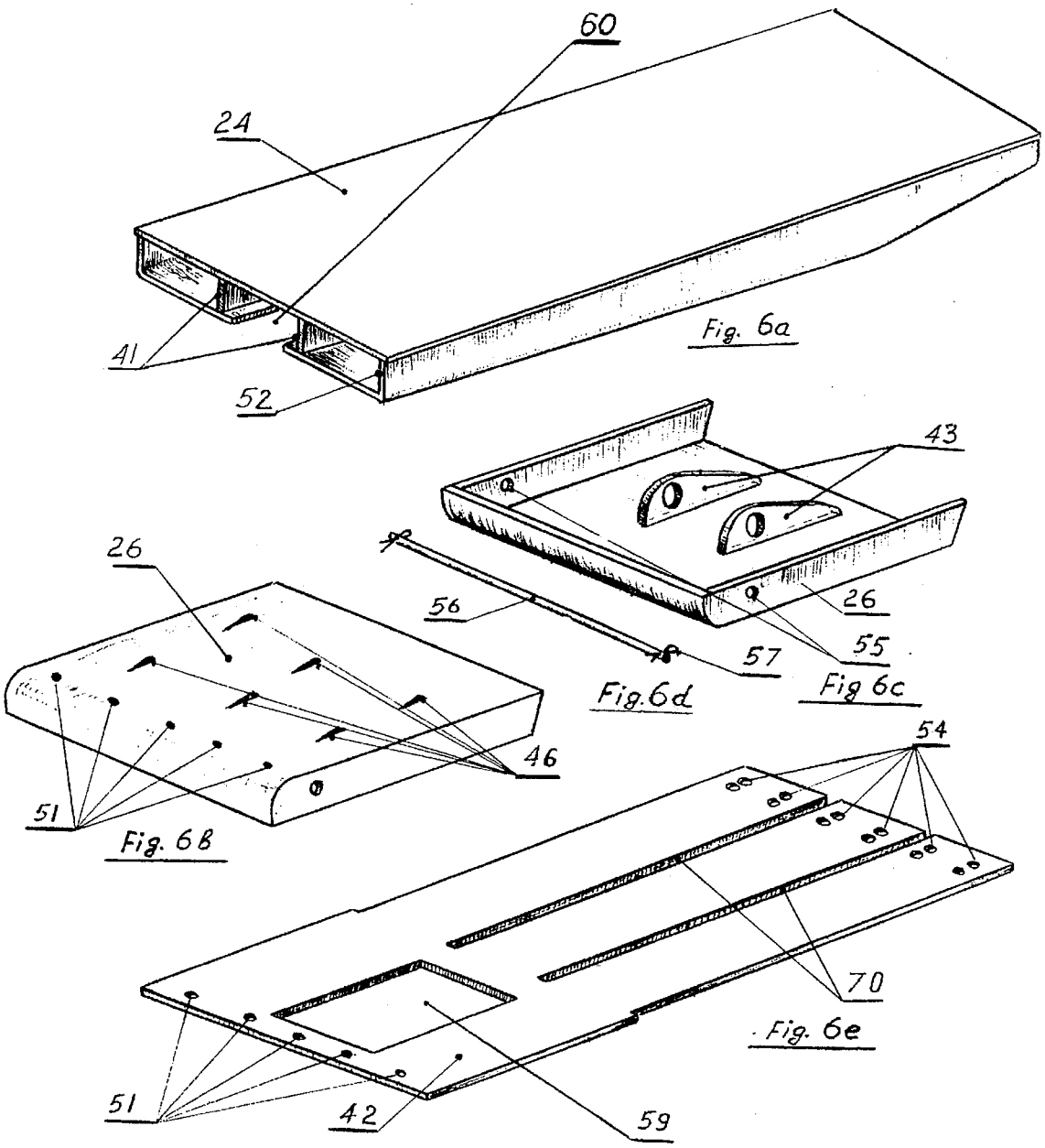
FIG. 6*a* is a view of the modifications of a roof covering necessary for tandem operation with the sliding stabilizer.
FIG. 6*b*, 6*c*, and 6*d* are views of the rigid thorns, the hard brackets and fixing rod of a peak.
FIG. 6*e* is a view of the connecting elements of a flexible sheet.
Figure 11A:
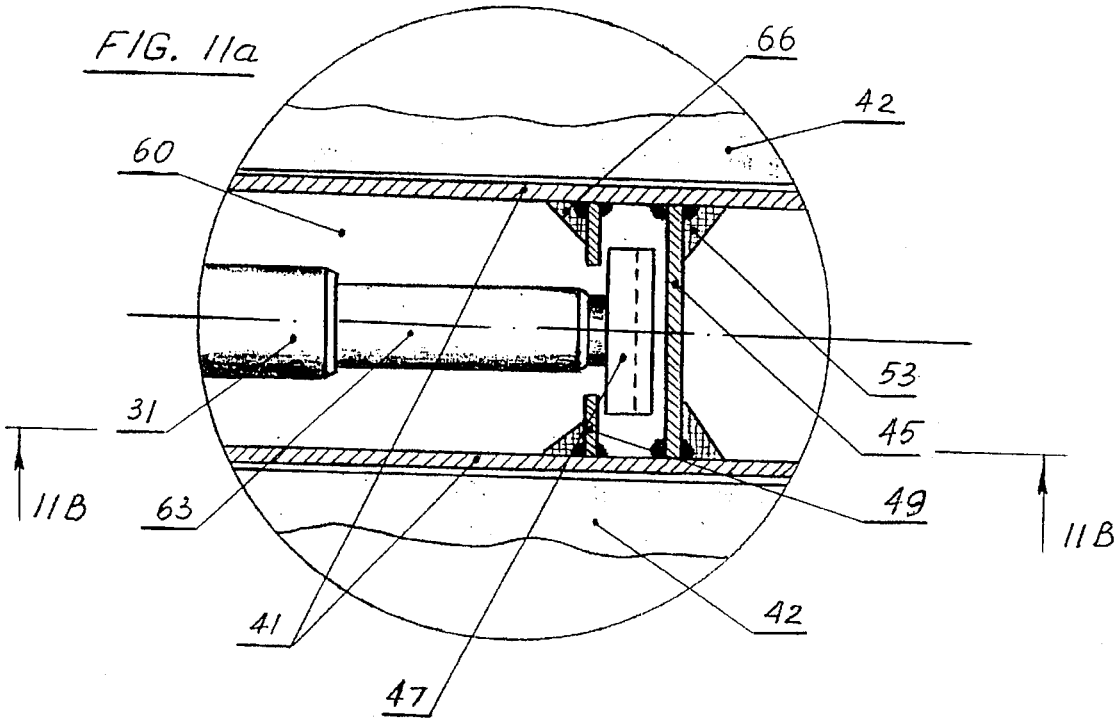
FIGS. 11*a*, 11*b* are diagrams from below and the side respectively of a retractable leg in the hollow of a roof covering.
Figure 11B:
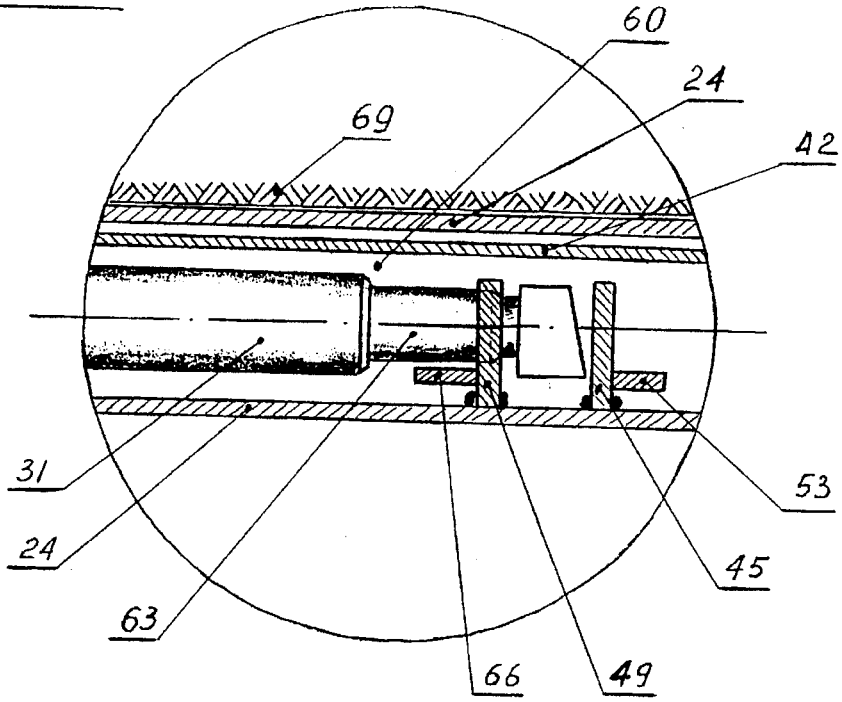

With reference to FIGS. 6*a*, 11*a*, 11*b* and other illustrations, a roof covering 24 has sidewalls 52 and cover ribs 41. Between the ribs 41 is a cover hollow 60. In the hollow 60 are a stopper plate 45, stopper wedges 53, rib brackets 49, and rib wedges 66. The rib brackets 49 secure the retractable leg 31 in the hollow 60.

Figure 2A:
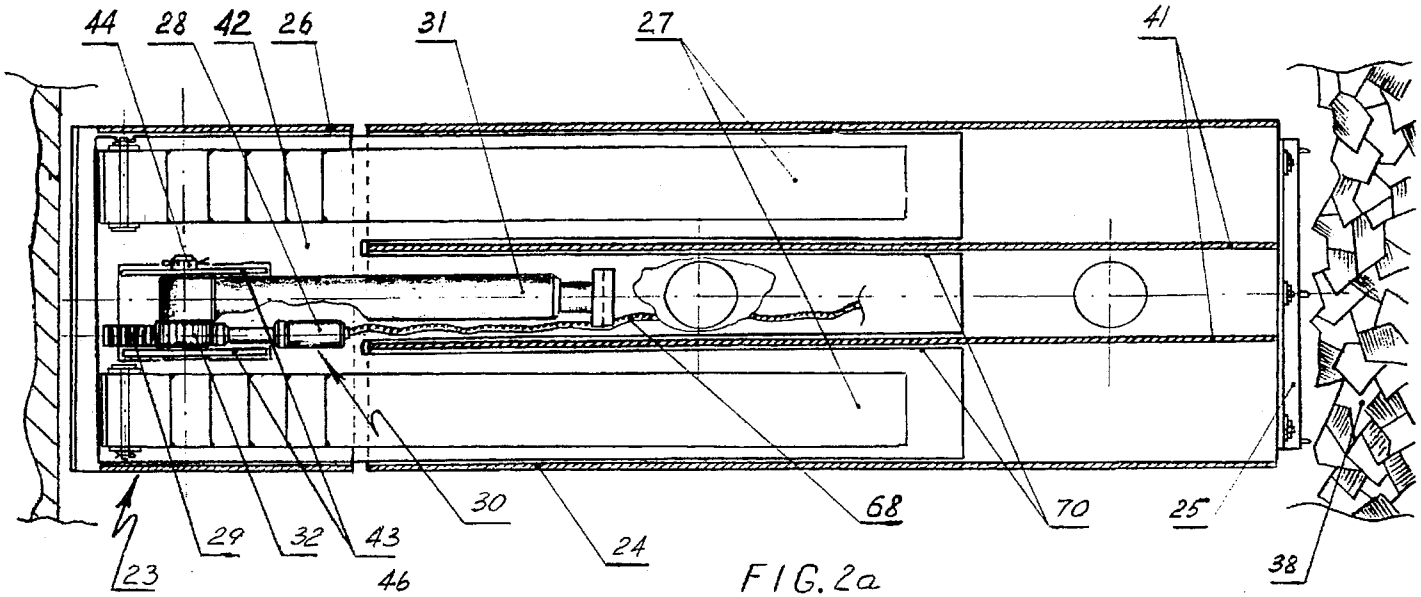
FIG. 2*a* is a diagram from below of the roof covering and the sliding stabilizer.
Figure 2B:
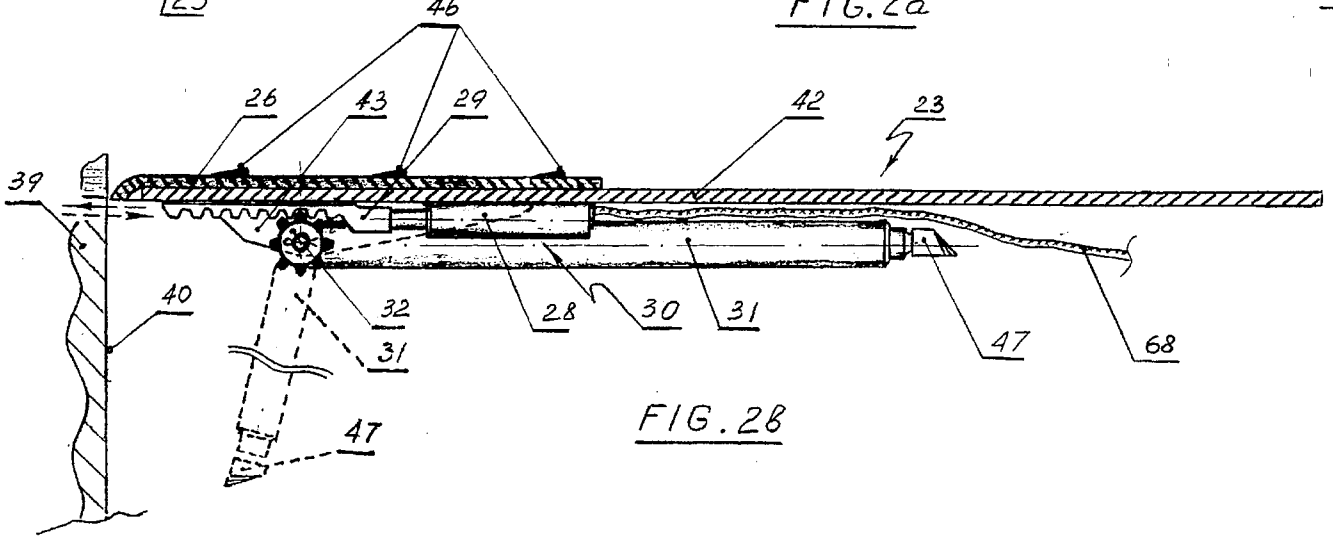
FIG. 2*b* is a sideways view of a sliding stabilizer when the retractable leg is raised.
Figures 3A, 3B, 3C, 3D, 3E:
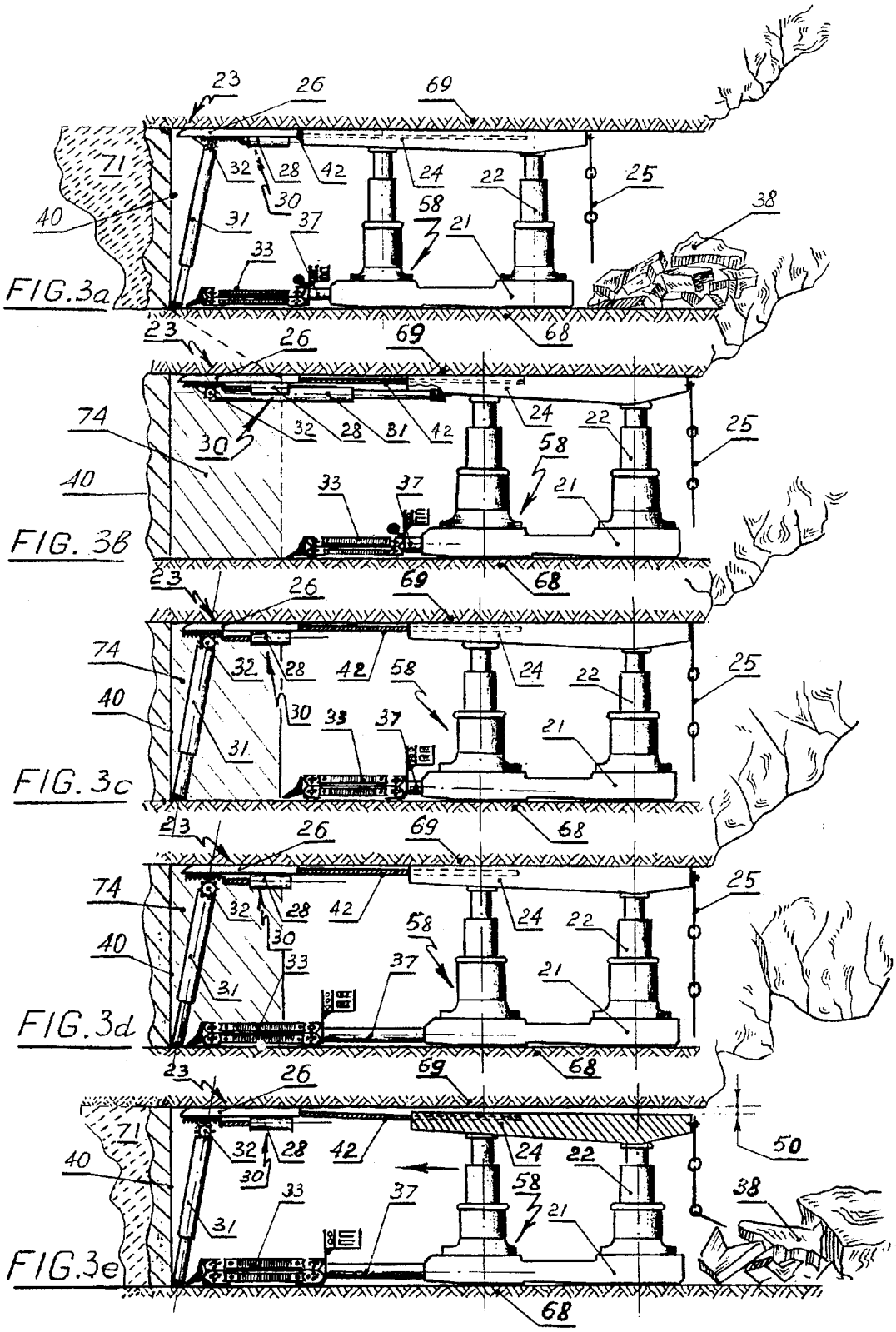
FIGS. 3*a*–3*e* are a series of diagrams of the position of a mining equipment set in accordance with the innovations of a sliding stabilizer.

With reference to FIGS. 2*a*, 2*b* and other illustrations, a sliding stabilizer 23 has a peak 26, a flexible sheet 42, expandable springs 27, a sliding tongue 30, and a retractable leg 31.

Figure 8:
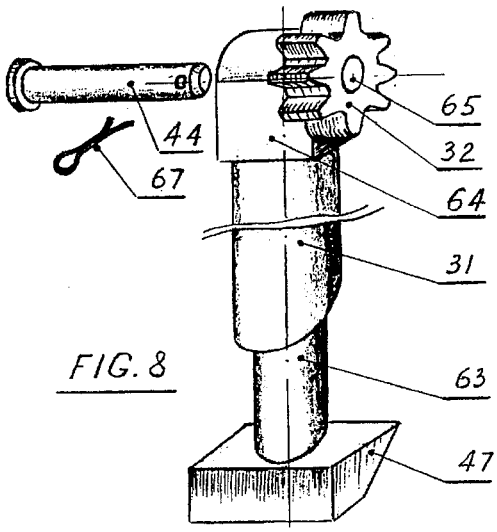
FIG. 8 is a diagram of assembly of a retractable leg.
Figure 10:
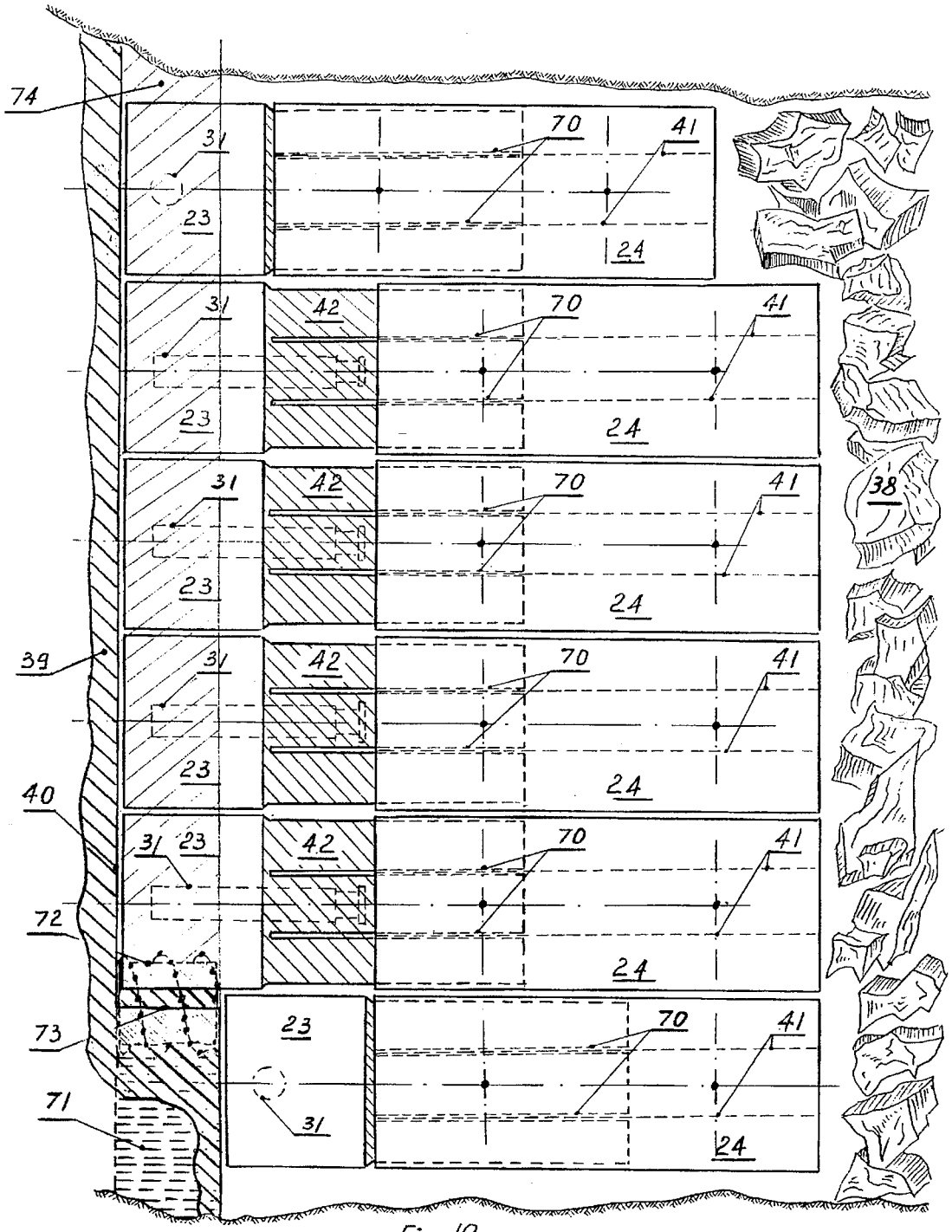
FIG. 10 is a diagrammatic view from above of a mine. This diagram illustrates the reinforcing of the roof immediately after the pass of a shearer.

With reference to FIG. 8 and other illustrations, a retractable leg 31 has a gear wheel 32, a leg head 64, a leg stem 63, and a leg heel 47. An assembly pin 44 is fit through an assembly hole 65 in the leg head 64 to join the retractable leg 31 to the peak 26. The assembly pin 44 is se, cured by a cram pin 67.

With reference to FIGS. 6b–6d and other illustrations, the peak 26 has peak thorns 46 and hard brackets 43. Fixing holes 55, a fixing rod 56 and a cram pin 57 are used for joining the peak 26 to the expandable springs 27.

Figure 7B:
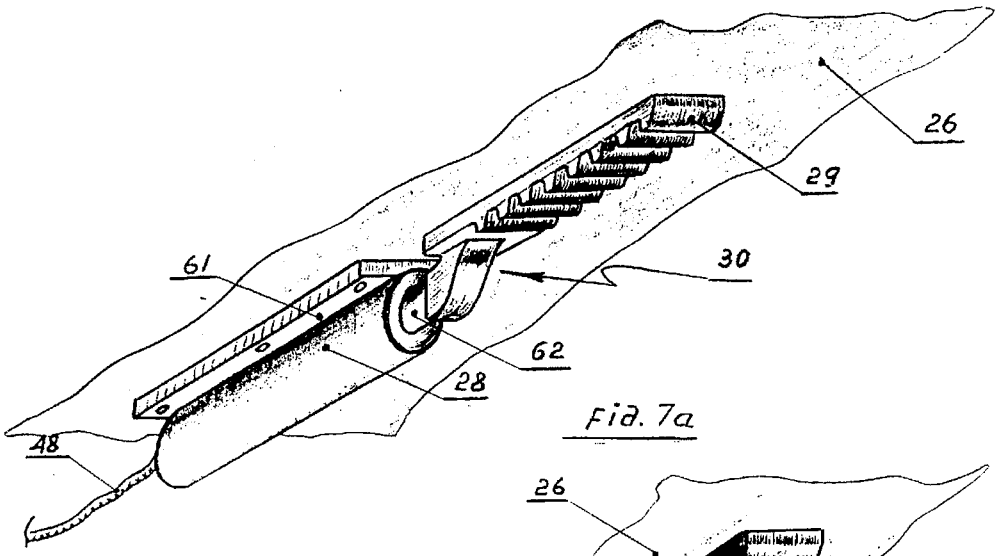
Figure 7B:
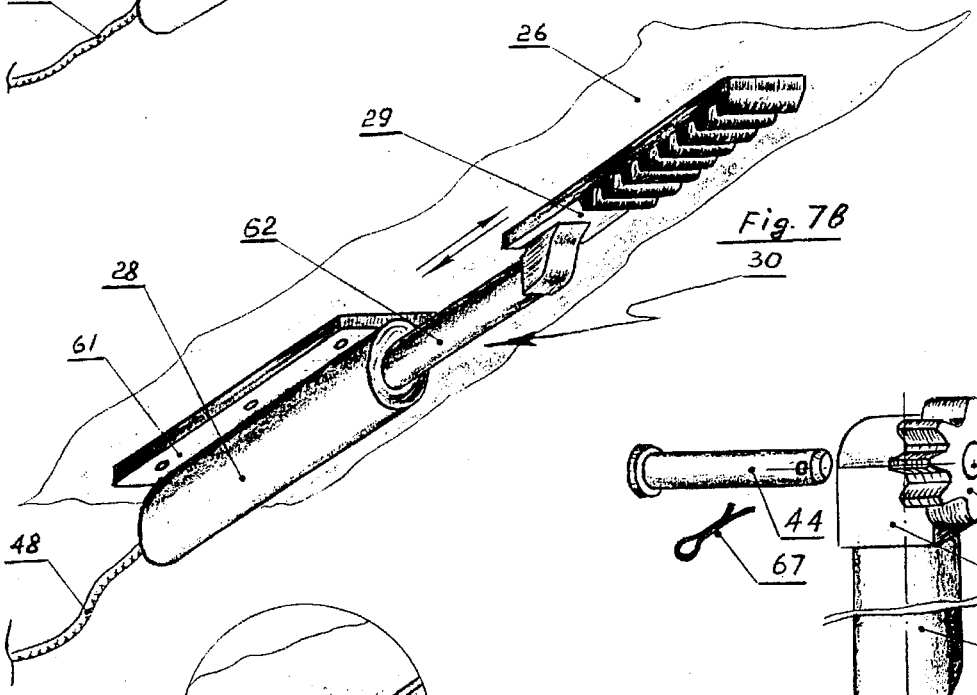
Figure 9:
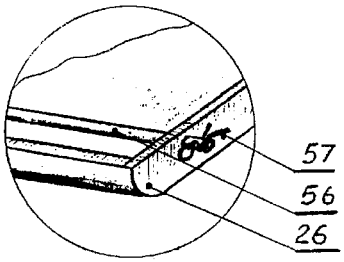
FIG. 9 is a view of a fragment of the peak showing its connection with a fixing rod.

With reference to FIGS. 7a, 7b and other illustrations, a sliding tongue 30 has an hydraulic cartridge 28, a cartridge stem 62, a toothed tongue 29 and a flexible hose 48. The sliding tongue 30 is joined to the peak 26 by a cartridge plate 61.

Figures 4A, 4B:
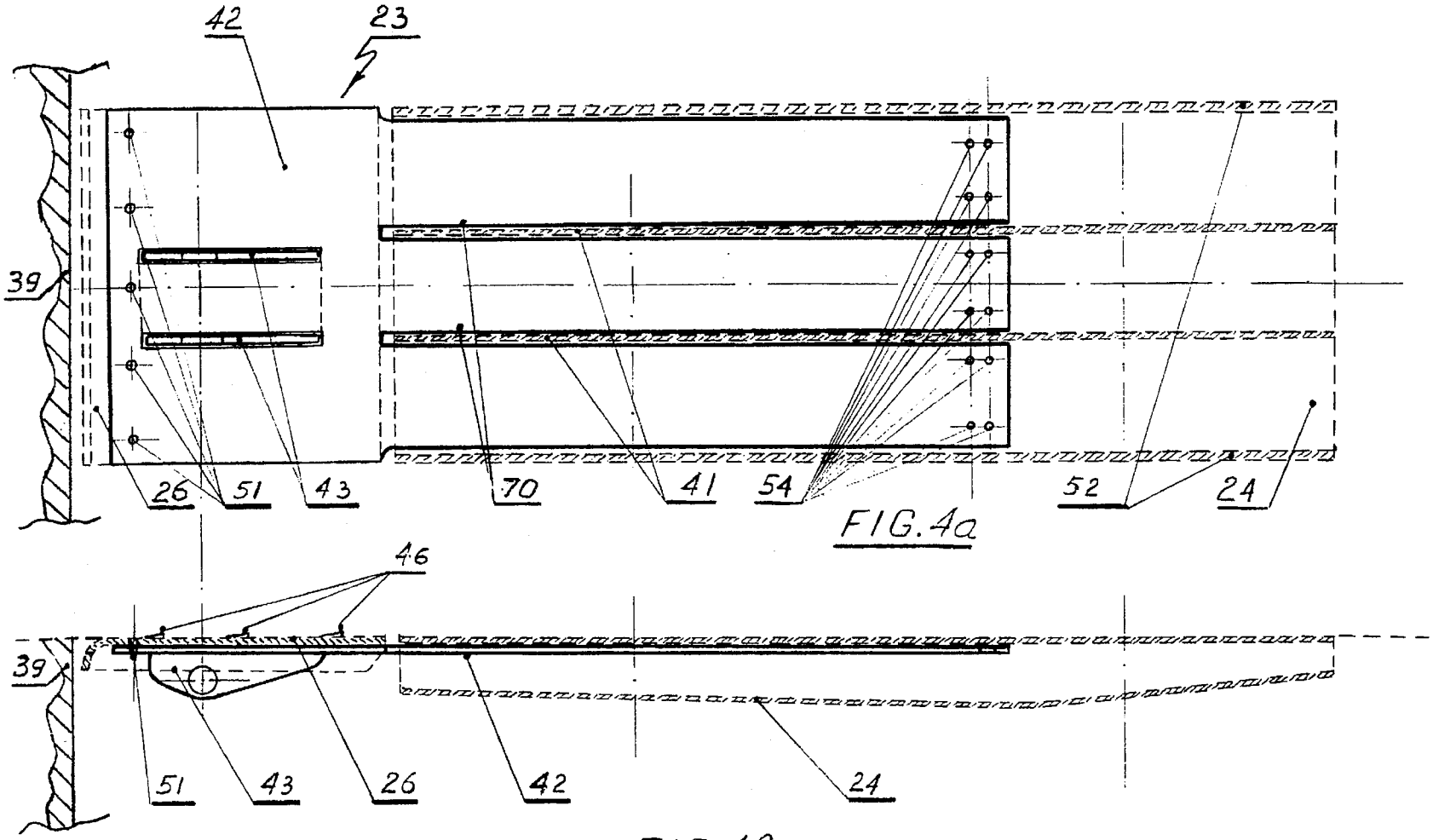
FIGS. 4*a*, 4*b* are views from below and sideways respectively of the flexible sheet of a sliding stabilizer.

With reference to FIGS. 4a, 6e and other illustrations, a flexible sheet 42 joins a peak 26 at the peak junction 51. A flexible sheet 42 is joined to the expandable springs 27 at the springs junction 54. The hard brackets 43 and sliding tongue 30 fit through the sheet hole 59. The sheet runners 70 are slid through the ribs 41 of the roof covering 24.

With reference to FIGS. 1, 3a–3e and other illustrations, a longwall mine has a mineral seam 39, roof 69, floor 68, and gob 38. A mineral seam 39 has, a mineral face 40, a web 71, a narrow face 73, a working zone 74, and a ventilation zone 78. A roof gap 50 is created when the roof covering 24 of the support machine 58 is lowered.

Figure 12A:
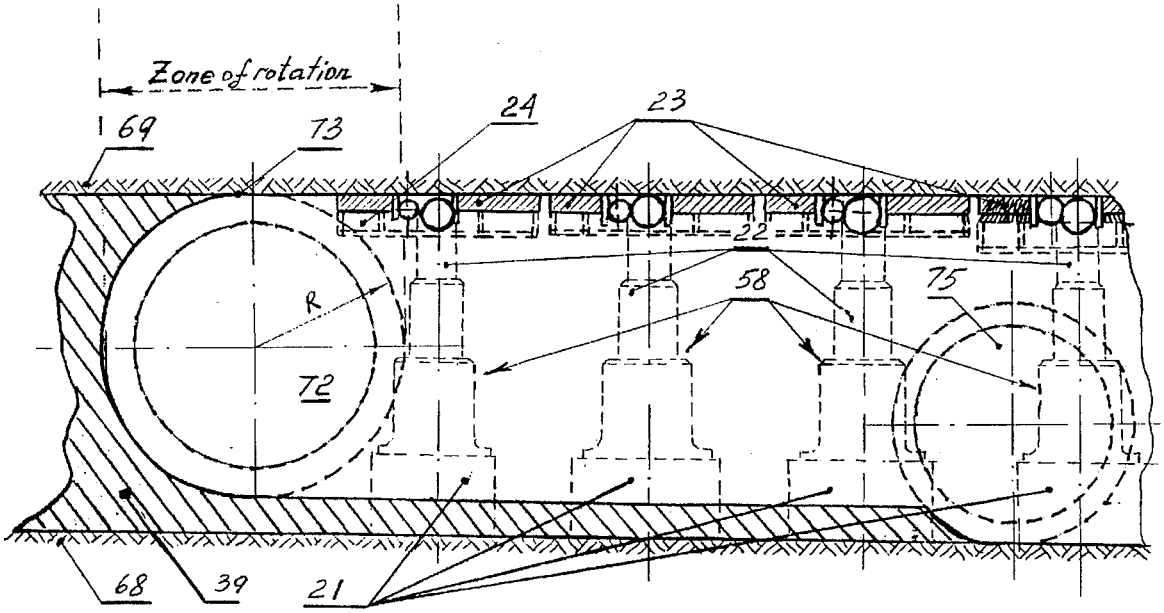
FIGS. 12*a*, 12*b* are diagrams from behind showing a sliding stabilizer within the zone of rotation of a shearer drum.
Figure 12B:
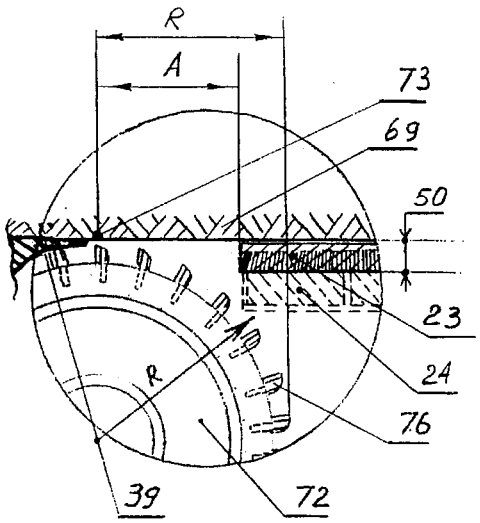

With reference to FIGS. 12a, 12b, 16c and other illustrations, a shearer 77 has a left drum 72 and a right drum 75. The drums both have drum teeth 76.

Figure 15A:
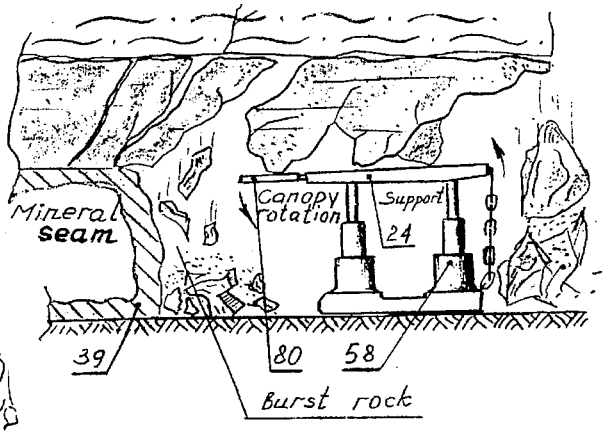
FIG. 15*a* is a diagram of prior art.

With reference to the prior art in FIG. 15a, the support machine 58 has a rigid canopy 80 that rotates due to rock bursts.

Figure 16A:
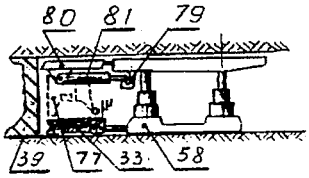
FIG. 16*a* is a diagram of prior art, Soviet patent #1109524. The support machine is in a thin seam with the shearer unable to pass.

With reference to the Soviet prior art in FIGS. 16a, 17e, and 17f, the support machine 58 has a canopy 80. The canopy 80 has an hydraulic cartridge 86 that rotates an hydraulic leg 81, but only as far as the fixing hook 79. When the hydraulic props 22 are lowered, the canopy sheet 96 will break at the canopy junction 90.

With reference to the Donbass 5 prior art in FIGS. 17c and 17d, the support machine 58 has a canopy 80. The canopy 80 has; a cylinder leg 82 a piston cylinder 85 and a piston rod 84. When the hydraulic props 22 are lowered, the mineral face 40 will burst 89.

With reference to the German prior art in FIGS. 17a and 17b, the support machine 58 has a telescoping canopy 88. The canopy 88 has an hydraulic cartridge 86 and hydraulic leg 8. When the hydraulic props 22 are lowered, the telescoping canopy 88 will break.

OPERATION OF THE INVENTION

A sliding stabilizer 23 operates in tandem with a roof support machine 58. A sliding stabilizer 23 is capable of supporting a mine roof 69 independently of a support machine 58. A sliding stabilizer 23 provides safety, support, stability, ventilation, and working space at the most crucial times during mineral extraction. A sliding stabilizer 23 is capable of operating with any support machine 58 that has the proper modifications to its roof covering 24. See FIG. 1.

The two main purposes of a sliding stabilizer 23 are:

(1) to provide support to the mine roof 69 in the working zone 74 of the mine immediately after the passing of a shearer 77; and (2) to provide support to the mine roof 69 when the covering 24 of the support machine 58 is lowered to allow the support machine 58 to advance toward the new mineral face 40.

The sequence of operation for a sliding stabilizer 23 to fulfill the above two purposes as shown in FIGS. 3a–3e, 16c are as follows:

(1) A mine roof 69 is supported by support machine 58. A conveyor 33 is on the mine floor 68 in front of the support machine 58. A sliding stabilizer 23 is in front of the mineral face 40 in its closest position to the roof covering 24. The peak 26 of the sliding stabilizer 23 is secured against the roof 69 by a vertical unclenched retractable leg 31. The leg heel 47 of the sliding stabilizer 23 is directly in front of the mineral face 40. See FIG. 1, FIG. 3a.

(2) The retractable leg 31 is clenched. A sliding tongue 30 and gear wheel 32 raise the retractable leg 31 out of the working zone 74 and compactly into the roof covering 24 as a shearer 77 passes. The retractable leg 31 is then unclenched pushing the peak 26 into the working zone 74. A sliding stabilizer 23 is capable of operating in the working zone 74 immediately after the shearer 77 passes and supporting the previously insupportable roof 69 of the working zone 74. See FIG. 3b.

(3) A retractable leg 31 is rotated to a position in front of a mineral face 40 by a sliding tongue 30 and gear wheel 32. The re, tractable leg 31 is unclenched and the peak 26 is secured against the roof 69, preventing canopy rotation and rock bursts. A conveyor 33 is then advanced toward the mineral face 40. See FIGS. 3c, 3d.

(4) The roof covering 24 of the support machine 58 is lowered bending the flexible sheet 42. Then the support machine 58 advances toward the new mineral face 40, while the sliding stabilizer 23 is secured against the mine roof 69 and floor 68. See FIG. 3e.

Figures 5A, 5B, 5C:
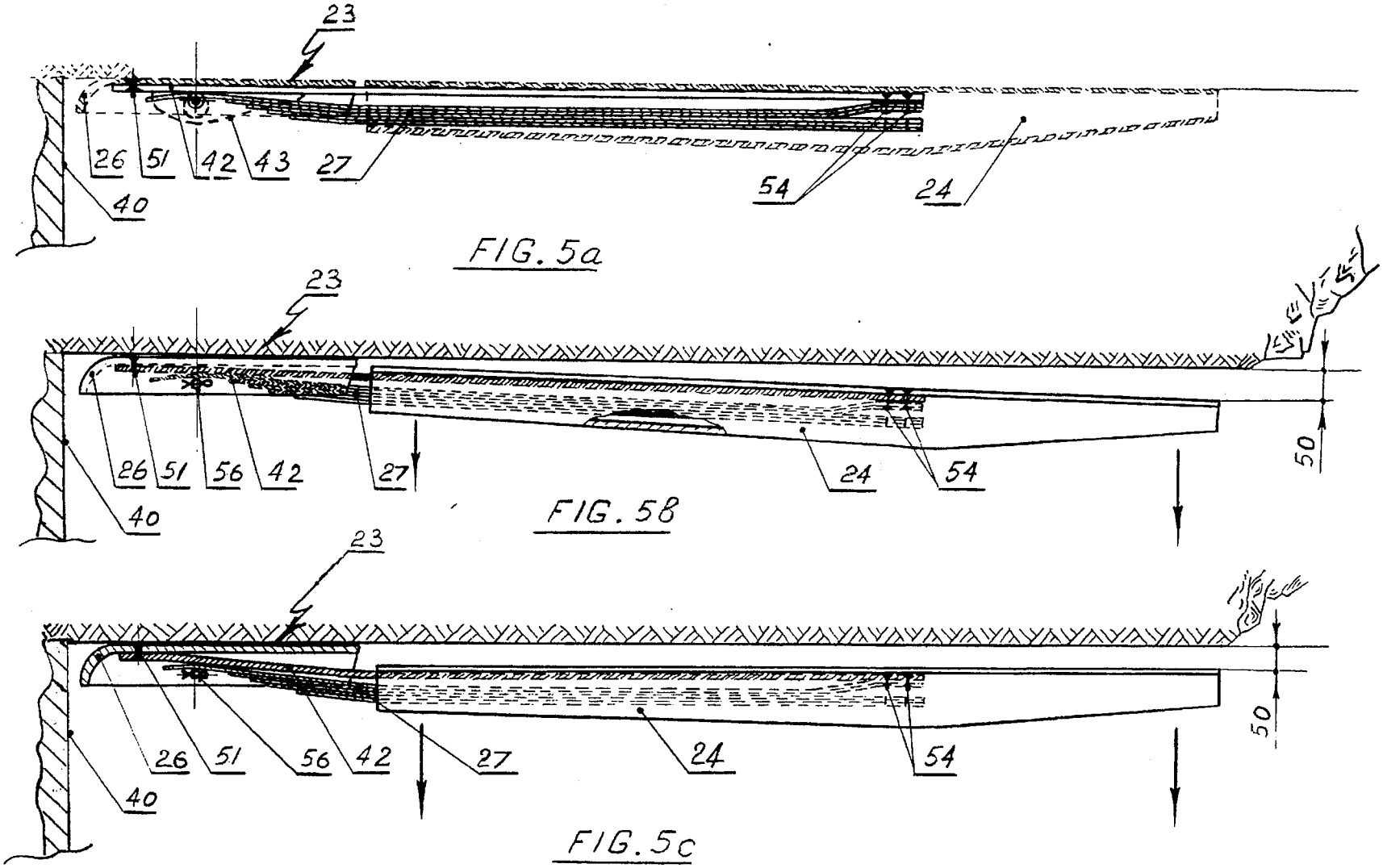
FIGS. 5*a*, 5*b*, and 5*c* are a series of views of the interaction between a roof covering and the peak, the expandable springs and the flexible sheet of a sliding stabilizer.

Expandable springs 27 provide tension by pushing the flexible sheet 42 securely against the peak 26 and the top of the roof covering 24 during the entire sequence of operation of the sliding stabilizer 23 and the support machine 58. See FIGS. 5a, 5b, 5c.

A sliding tongue 30 interacts with a gear wheel 3,2 to rotate a retractable leg 31. The retractable leg 31 operates hydraulically to push the sliding stabilizer 23 into toward the mineral face 40. See FIG. 2b. The leg heel 47 pushes against the stopper plate 45 in the cover hollow 40. This pushing extends the flexible sheet 42. See FIGS. 11a, 11b.

Figure 16B:
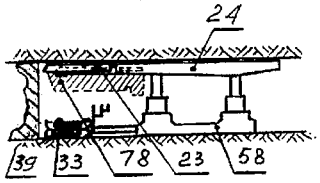
FIG. 16*b* is a diagram showing the increased ventilation and working space using the sliding stabilizer in a thin seam.

A sliding stabilizer 23 operates in thin seams. The retractable leg 31 of a sliding. stabilizer 23 is raised compactly into a roof covering 24. This allows the shearer 77 to pass the sliding stabilizer 23 while the peak 26 is supporting the mine roof 69. See FIGS. 16a, 16b, 16c.

Figure 14:
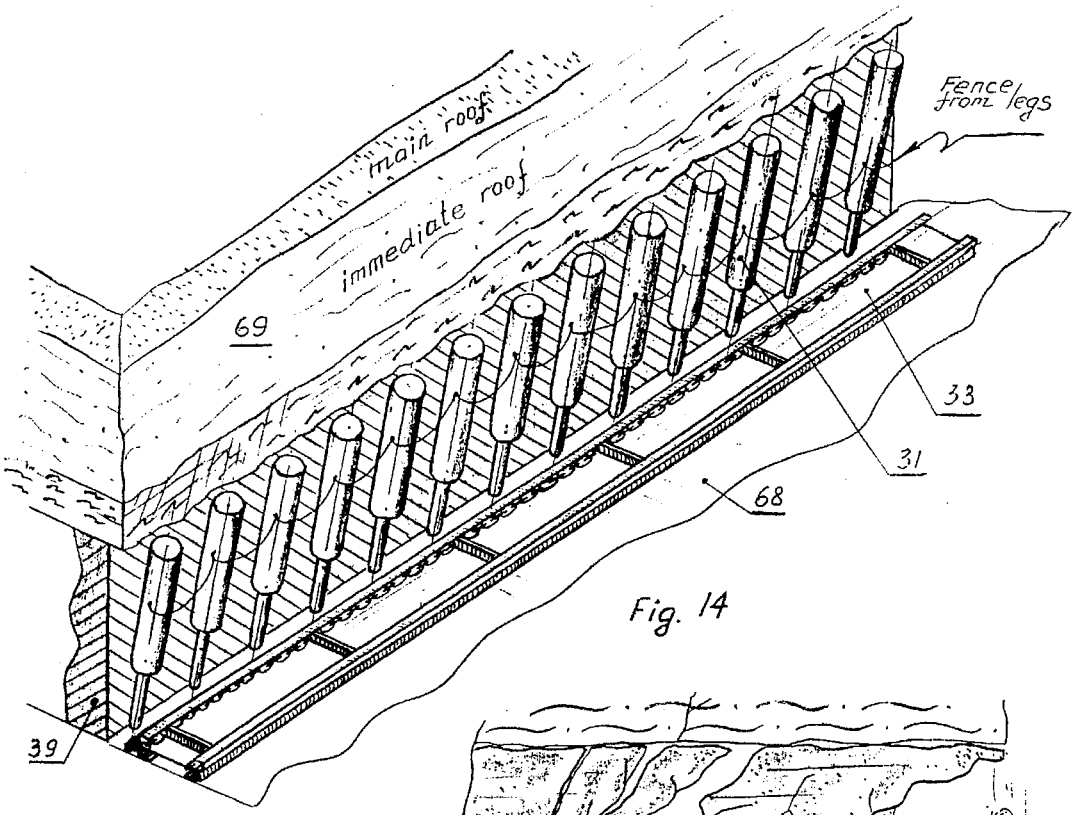
FIG. 14 is a perspective view of a series of retractable legs forming a fence in front of mineral seam.
Figure 15B:
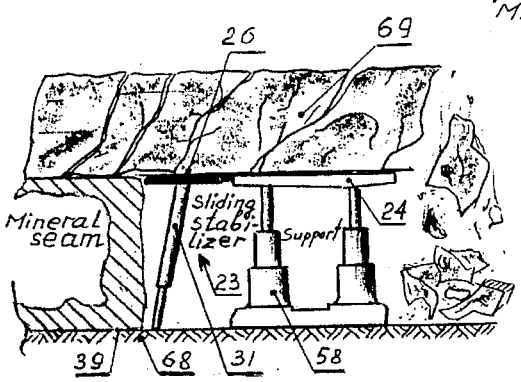
FIG. 15*b* is a diagram of a support machine operating in tandem with a sliding stabilizer during a rock burst.

A sliding stabilizer 23 has a leg 31 at the furthest point from the hydraulic props 22 of the support machine 58. This provides the stability lacking in oversize roof coverings 24. See FIGS. 15a, 15b. A series of retractable legs 31 provide a fence to protect against mineral burst from the mineral seam 39. See FIG. 14.

Figure 13A:
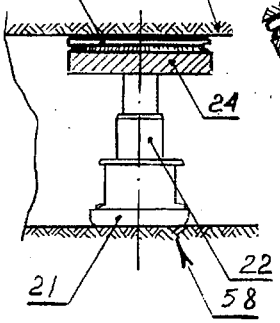
FIGS. 13*a*, 13*b* are diagrams from behind of a level and an inclined mining support machine.
Figure 13B:
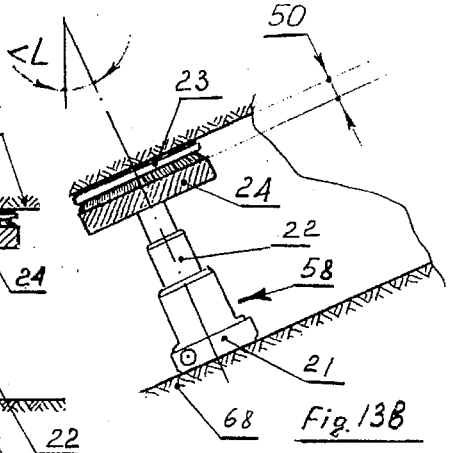

A sliding stabilizer 23 operates to prevent a support machine 58 from falling over in inclined seams. The roof covering 24 is lowered to allow the support machine 58 to advance. The sliding stabilizer 23 is secure against the mine roof 69. See FIGS. 13a, 13b. Runners 70 of a flexible sheet 42 extend from the peak 26 to the ribs 41 of the roof covering 24. These secure runners 70 prevent the support machine 58 from falling over FIGS. 4a, 4b.

A sliding stabilizer 23 operates to prevent canopy 80 rotation. See FIG. 15a, 15b. When the retractable leg 31 is unclenched, rigid thorns 46 hold the peak 26 securely against the mine roof 69 (not shown in FIG. 2b). This prevents the sliding stabilizer 23 from jumping back toward the support machine 58 during rock bursts. See FIG. 2b.

A sliding stabilizer 23 operates to prevent canopy 80 breakage when the roof covering 24 is lowered. See FIGS. 17a–17f. The flexible sheet 42 is attached to the peak 26 at the peak junction 51. The peak junction 51 is in the front of the peak 26 for maximum flexibility, preventing canopy breakage. See FIGS. 5*a*, 5*b*, 5*c*.

SUMMARY, RAMIFICATIONS, AND SCOPE

The retractable leg of a sliding stabilizer is rotated to a position in front of a mineral face. The peak is then secured against the roof of the working zone by unclenching the retractable leg. This creates support independent of the support machine. The roof covering of a support machine is lowered creating a roof gap. The support machine then advances towards the new mineral face.

The features of this operation are:

(1) the rock burst problem from the unsupported roof created by a passing shearer is eliminated;

(2) the rock burst problem from the large unsupported roof created when the roof covering of the support machine is lowered is eliminated;

(3) this eliminates the problem caused by oversize roof coverings on support machines;

(4) a series of sliding stabilizers form a fence to protect against mineral bursts from the mineral face;

(5) in inclined seams the runners of the flexible sheet provide support and stability to the roof covering, preventing the support machine from falling over;

No prior canopy has been able to support the mine roof while the roof cover of the support machine is lowered. Only a sliding stabilizer is capable of providing independent support. All canopies without legs suffer from canopy rotation caused by rock bursts. A sliding stabilizer prevents canopy rotation.

All prior canopies with legs interfere with the working zone in thin seams. Only a sliding stabilizer has a leg that fits compactly into the roof covering of the support machine. All prior canopies with legs break when the roof covering of the support machine is lowered. Only a sliding stabilizer has a sheet flexible enough not to break when the roof covering is lowered.

A sliding stabilizer provides safety, support, stability, ventilation, and working space at the most crucial times during the mineral extraction. The description above contains many specifics. These specifics should not be construed as limiting the scope of the invention. The scope of the invention should be determined by the appended claims.

What is claimed as new and desired to be protected by Letters Patent is set forth in the appended claims:

1. A sliding stabilizer for supporting a roof in a work zone of a mine in tandem with a mine roof support machine comprising:

a hood smaller than a roof covering of the support machine;

a flexible sheet joined to the hood, the flexible sheet extending toward and engaging the roof covering of the support machine;

a junction of the flexible sheet and hood in the half of the hood furthest from the roof covering of the support machine;

a leg mounted to the hood and having a gear wheel; and a means for rotating the gear wheel.

2. The sliding stabilizer of claim 1 with rigid thorns attached to the hood.

* * * * *